US012208444B2

(12) United States Patent
Nishida et al.

(10) Patent No.: US 12,208,444 B2
(45) Date of Patent: Jan. 28, 2025

(54) POURING FACILITY

(71) Applicants: SINTOKOGIO, LTD., Nagoya (JP); Fujiwa Denki Co., Ltd., Aichi (JP)

(72) Inventors: Tadashi Nishida, Aichi (JP); Masanori Hoshino, Aichi (JP); Toshiyuki Hyodo, Aichi (JP)

(73) Assignees: SINTOKOGIO, LTD., Nagoya (JP); Fujiwa Denki Co., Ltd., Aichi (JP)

( * ) Notice: Subject to any disclaimer, the term of this patent is extended or adjusted under 35 U.S.C. 154(b) by 0 days.

(21) Appl. No.: 18/205,705

(22) Filed: Jun. 5, 2023

(65) Prior Publication Data

US 2023/0398603 A1 Dec. 14, 2023

(30) Foreign Application Priority Data

Jun. 10, 2022 (JP) ..... 2022-094201

(51) Int. Cl.
*B22D 47/02* (2006.01)
*B22D 41/04* (2006.01)
*B22D 43/00* (2006.01)

(52) U.S. Cl.
CPC ..... *B22D 47/02* (2013.01); *B22D 41/04* (2013.01); *B22D 43/001* (2013.01)

(58) Field of Classification Search
CPC ..... B22D 41/04; B22D 43/00; B22D 43/001; B22D 47/02
USPC ..... 164/322, 323, 324
See application file for complete search history.

(56) References Cited

U.S. PATENT DOCUMENTS

| | | | | |
|---|---|---|---|---|
| 2,713,703 | A * | 7/1955 | Lasater et al. | B22D 33/04 164/168 |
| 3,029,482 | A * | 4/1962 | Burnett | B22D 33/02 164/76.1 |
| 3,955,613 | A * | 5/1976 | Lund | B22D 33/00 198/795 |
| 3,977,461 | A * | 8/1976 | Pol et al. | B22D 47/00 164/323 |
| 4,299,269 | A * | 11/1981 | Friesen et al. | B22D 45/00 164/394 |
| 4,589,467 | A * | 5/1986 | Hunter | B22D 33/00 164/322 |
| 6,216,767 | B1 * | 4/2001 | McMellon | B22D 47/00 164/324 |
| 2019/0247917 | A1 | 8/2019 | Nishida et al. | |

FOREIGN PATENT DOCUMENTS

JP 6472899 B2 2/2019

* cited by examiner

*Primary Examiner* — Kevin P Kerns
(74) *Attorney, Agent, or Firm* — Faegre Drinker Biddle & Reath LLP

(57) ABSTRACT

A pouring facility includes a mold conveying device configured to convey a mold, a molten-metal discharging container configured to store waste molten metal, and a pouring machine movable on a conveyance path located between the mold conveying device and the molten-metal discharging container, the pouring machine being configured to tilt a ladle in a first direction to pour molten metal into the mold conveyed by the mold conveying device, and tilt the ladle in a second direction opposite to the first direction to discharge waste molten metal into the molten-metal discharging container.

7 Claims, 18 Drawing Sheets

POURING FACILITY

CROSS-REFERENCE TO RELATED APPLICATION

This application is based on Japanese Patent Application No. 2022-094201 filed with Japan Patent Office on Jun. 10, 2022, the entire contents of which are hereby incorporated by reference.

TECHNICAL FIELD

The present disclosure relates to pouring facility.

BACKGROUND

Japanese Patent No. 6472899 discloses pouring facility. The pouring facility includes a mold conveying device for conveying molds, and a pouring machine for pouring molten metal in a ladle into the conveyed molds.

SUMMARY

The pouring facility described in Japanese Patent No. 6472899 has room to be improved from the viewpoint of efficiently discharging molten metal. The present disclosure provides pouring facility capable of efficiently discharging molten metal.

Pouring facility according to one aspect of the present disclosure includes a mold conveying device, a molten-metal discharging container, and a pouring machine. The mold conveying device conveys a mold. The molten-metal discharging container stores waste molten metal. The pouring machine is movable on a conveyance path located between the mold conveying device and the molten-metal discharging container, and is configured to tilt a ladle in a first direction and pour molten metal into a mold conveyed by the mold conveying device, and also to tilt the ladle in a second direction opposite to the first direction and discharge molten metal into the molten-metal discharging container.

In the pouring facility of the present disclosure, the ladle is tilted in the first direction by the pouring machine, and the molten metal in the ladle is poured into the mold conveyed by the mold conveying device. The ladle can also be tilted in the second direction opposite to the first direction by the pouring machine. Since the pouring machine moves on a conveyance path located between the mold conveying device and the molten-metal discharging container, the molten-metal discharging container is present in the second direction opposite to the first direction. In other words, when the ladle is tilted in the second direction by the pouring machine, waste molten metal in the ladle is discharged into the molten-metal discharging container. In this way, the pouring facility can tilt the ladle in the first direction to perform a treatment of pouring molten metal into the mold, and tilt the ladle in the second direction to perform a treatment of discharging molten metal into the molten-metal discharging container. Therefore, the pouring facility can discharge the molten metal without moving the pouring machine from a pouring zone, so that the waste molten metal can be discharged efficiently.

In one embodiment, the pouring machine may include a tilting frame configured to place the ladle thereon and tilt together with the ladle, and a fixing member configured to fix the ladle to the tilting frame. In this case, the pouring machine can tilt the ladle by operating the tilting frame.

In one embodiment, the ladle may include a pin receiving portion, and the fixing member may be provided on the tilting frame, and include a pin to be fitted in the pin receiving portion and a pin drive unit configured to drive the pin in an up-and-down direction. In this case, the pin provided on the tilting frame is fitted in the pin receiving portion of the ladle. As a result, the fixing member can fix the ladle to the tilting frame.

In one embodiment, the tilting frame may have a wall member against which the ladle abuts, and the fixing member may be provided on the tilting frame and include a clamping member configured to clamp the ladle between the clamping member and wall member, and a clamp drive unit configured to drive the clamping member. In this case, the ladle that abuts against the wall member is clamped and fixed between the wall member and the clamping member of the tilting frame. As a result, the fixing member can fix the ladle to the tilting frame.

In one embodiment, a launder for guiding molten metal from the ladle to the molten-metal discharging container may be further provided. In this case, the pouring facility can discharge molten metal in the ladle to the molten-metal discharging container through the launder.

In one embodiment, a launder moving mechanism for moving the launder according to a position of the pouring machine may be further provided. In this case, since the pouring facility can adjust the position of the launder, the molten metal in the ladle can be more reliably discharged to the molten-metal discharging container.

In one embodiment, the ladle may have a first tapping port for pouring molten metal into a mold and a second tapping port for discharging waste molten metal into the molten-metal discharging container, and when viewed from above the ladle, the first tapping port, a center of the ladle, and the second tapping port may be arranged to be aligned with one another. With such a configuration, the pouring facility can switch a molten metal treatment and a molten-metal discharging treatment to each other only by controlling the tilting direction of molten metal.

In one embodiment, the pouring machine may include a front-rear mechanism configured to move the tilting frame in a front-rear direction, a lifting mechanism configured to raise and lower the tilting frame, and a tilting mechanism configured to tilt the tilting frame. As a result, the pouring machine can arbitrarily change the posture of the ladle.

In one embodiment, the lifting mechanism may include at least one support member extending vertically and supporting the tilting frame, and at least one lifting drive unit configured to move the tilting frame along the at least one support member. In this case, the pouring facility can raise and lower the ladle along the support member.

According to various aspects and embodiments of the disclosure, pouring facility capable of efficiently discharging molten metal is provided.

DETAILED DESCRIPTION

Exemplary embodiments of the present disclosure will be described hereunder with reference to the drawings. In the following description, the same signs are given to the same or equivalent elements, and duplicate description thereon will not be repeated.

[Outline of Casting Facility]

Figure 1:
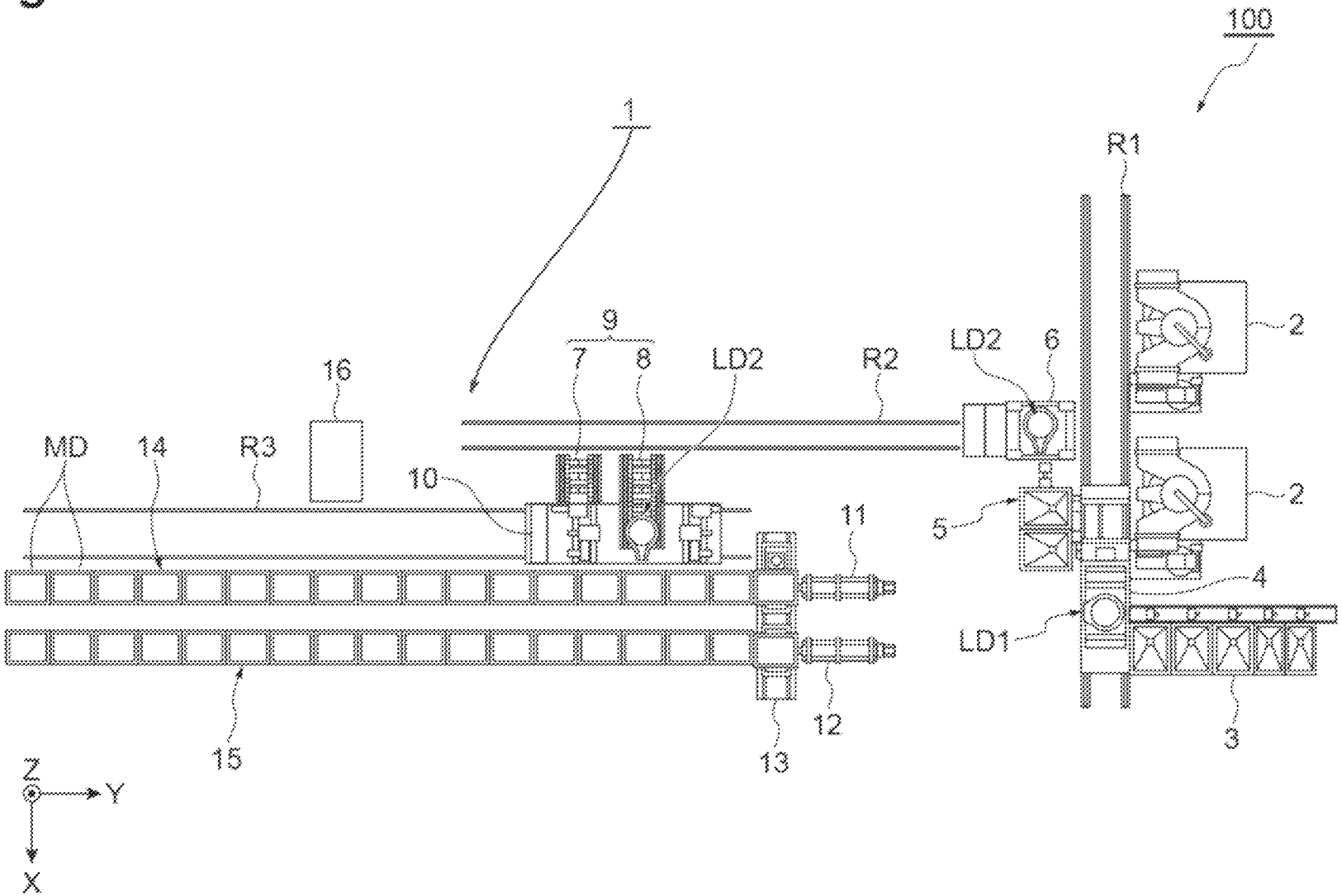
FIG. 1 is a plane view showing a part of casting facility including pouring facility according to an exemplary embodiment.

FIG. 1 is a plane view showing a part of casting facility including a pouring facility according to an exemplary embodiment. The casting facility 100 shown in FIG. 1 taps a part of raw molten metal obtained at a melting furnace into a ladle, transports the ladle containing the molten metal to a pouring machine, and pours the molten metal in the transported ladle into a mold by using the pouring machine. As shown in FIG. 1, the casting facility 100 includes a melting furnace 2 as an example. The melting furnace 2 melts a melting material with heat to obtain raw molten metal. The melting furnace 2 may be a single melting furnace, or a plurality of melting furnaces. In the example of FIG. 1, two melting furnaces 2 are arranged side by side. A corresponding melting material charging device is juxtaposed with the melting furnace 2, and melting material is charged into the furnace by the melting material charging device. The melting furnace 2 can acquire, at a time, the raw molten metal whose amount is sufficient to pour the molten metal into a molten-metal receiving ladle described later at a plurality of times.

The molten metal melted in the melting furnace 2 is tapped into a treatment ladle LD1. The treatment ladle LD1 is placed on a molten-metal receiving bogie 4, and moves along a molten-metal receiving bogie rail R1. Before receiving the molten metal, the molten-metal receiving bogie 4 moves to the position of a primary inoculation device 3 in order to adjust the components of the raw molten metal, and a material for adjusting the components of the raw molten metal is put into the treatment ladle LD1 by the primary inoculation device 3. Thereafter, the molten-metal receiving bogie 4 moves to a molten-metal receiving position, and the molten metal is tapped from the melting furnace 2 into the treatment ladle LD1. The molten-metal receiving bogie 4 moves to an emptying position at which the molten metal in the treatment ladle LD1 is emptied into a pouring ladle LD2. The emptying means that the molten metal is transferred to another ladle. When the molten metal is emptied from the treatment ladle LD1 to the pouring ladle LD2, an additive material is put into the pouring ladle LD2 by a secondary inoculation device 5 to adjust the components of the molten metal.

The pouring ladle LD2 is placed on a transportation bogie 6, and transported along a transportation bogie rail R2. In addition to the above-mentioned emptying position, the transportation bogie 6 can also stop at a ladle exchange position at which the pouring ladle LD2 is transported to the pouring machine 10.

The pouring ladle LD2 is conveyed along the transportation bogie rail R2, and arrives at the pouring facility 1. In the pouring facility 1, molten metal is poured into molds MD. The pouring ladle LD2 (full ladle) in which the molten metal is put is delivered from the transportation bogie 6 to a ladle exchange device 9 at a front stage of the pouring machine 10 (the ladle exchange position). In the ladle exchange device 9, the exchange between the full ladle and a pouring ladle LD2 (empty ladle) which has been emptied due to pouring of the molten metal is implemented. For example, the exchange between the full ladle and the empty ladle is implemented by sliding the pouring machine 10. For example, the pouring machine 10 slides to a front side of a roller conveyor 8, whereby the empty ladle is delivered from the pouring machine 10 to the roller conveyor 8. The pouring machine 10 slides to a front side of the roller conveyor 7, whereby the full ladle is delivered from the roller conveyor 7 to the pouring machine 10.

The pouring machine 10 pours the molten metal stored in the pouring ladle LD2 into molds MD. The pouring machine 10 is provided on a side of a pouring zone 14. In the pouring zone 14, a mold conveying device conveys a plurality of molds MD molded by a molding machine (not shown) one by one with the molds MD being arranged in a row. In the pouring zone 14, the pouring machine 10 pours the molten metal in the pouring ladle LD2 into a mold MD being conveyed.

A rail for the molds MD is laid in the pouring zone 14, and a pair of mold indexing devices 11 (a pusher and a cushion) which correspond to the mold conveying device are arranged at both ends of the rail. The pusher constituting the mold indexing device 11 has a function of pushing out the molds MD, and the cushion constituting the mold indexing device 11 has a function of receiving the molds MD which have been pushed out. The molds MD can be fed out without any gap therebetween by the pusher and the cushion. The mold indexing device 11 feeds out the molds MD one by one. In FIG. 1, only the mold indexing device (cushion) at the front end of the rail is shown, and the illustration of the mold indexing device (pusher) arranged at the rear end of the rail is omitted.

In the pouring zone 14, a pouring rail R3 (an example of a conveyance path) for the pouring machine is laid. The pouring rail R3 is laid along a rail for the molds. The pouring machine 10 allows the pouring ladle LD2 to be placed thereon, and is movable along the pouring rail R3. The pouring machine 10 moves to an arbitrary position on the pouring rail R3, tilts the pouring ladle LD2 in a first direction, and pours molten metal into the molds MD. The first direction is a tilting direction in which the molten metal is poured into the molds MD.

The molten-metal discharging container 16 for storing waste molten metal is installed in the pouring zone 14. The molten-metal discharging container 16 is a container for receiving waste molten metal in the pouring ladle LD2. The waste molten metal means that when the temperature of molten metal decreases to a threshold value or less, there is a change in the material of molten metal to be poured into molds MD, or molten metal for one mold or less remains, waste molten metal in the pouring ladle LD2 is discharged. Note that when there is a lot of remaining molten metal, returning of the molten metal is performed. Returning means that the molten metal is returned to the melting furnace together with the ladle with keeping a liquid state. For example, the pouring ladle LD2 is conveyed to the melting furnace 2 by lifting the pouring ladle LD2 with a crane or the like and transferring the pouring ladle LD2 to a roller conveyor that can digress from the line. The molten-metal discharging container 16 is arranged side by side with the pouring rail R3. In other words, the pouring machine 10 can move the pouring rail R3 located between the mold conveying device and the molten-metal discharging container 16.

When it is necessary to discharge waste molten metal, the pouring machine 10 moves to a position facing the molten-metal discharging container 16. Then, the pouring machine 10 tilts the pouring ladle LD2 in the second direction to discharge waste molten metal to the molten-metal discharging container 16. The second direction is a direction opposite to the first direction, and is a tilting direction in which waste molten metal is discharged to the molten-metal discharging container 16. The molten metal stored in the molten-metal discharging container 16 can be reused in the melting furnace 2 after it has been solidified. For example, the solidified waste molten metal is introduced together with a melting material when melting in the melting furnace is started.

When a mold MD reaches the front end of the rail in the pouring zone 14, it is transferred to an adjacent cooling zone 15 by a traverser 13. In the cooling zone, the mold MD is conveyed to a shake-out device (not shown) while a product after pouring is cooled in the mold MD. A rail for molds MD is laid in the cooling zone 15, and a pair of mold indexing devices 12 (a pusher and a cushion) are arranged at both ends of the rail as in the case of the pouring zone 14. In FIG. 1, only the mold indexing device (pusher) at the rear end of the rail is illustrated, and illustration of the mold indexing device (cushion) arranged at the front end of the rail is omitted. The operation of the mold indexing device 12 is the same as that of the mold indexing device 11. Molds MD in the cooling zone 15 are conveyed in a direction opposite to the conveying direction of the molds MD in the pouring zone 14 by the mold indexing device 12. Molds MD after pouring are cooled over time on the rail, and the molten metal is solidified into a casting before reaching the shake-out device.

[Details of Pouring Machine]

Figure 2:
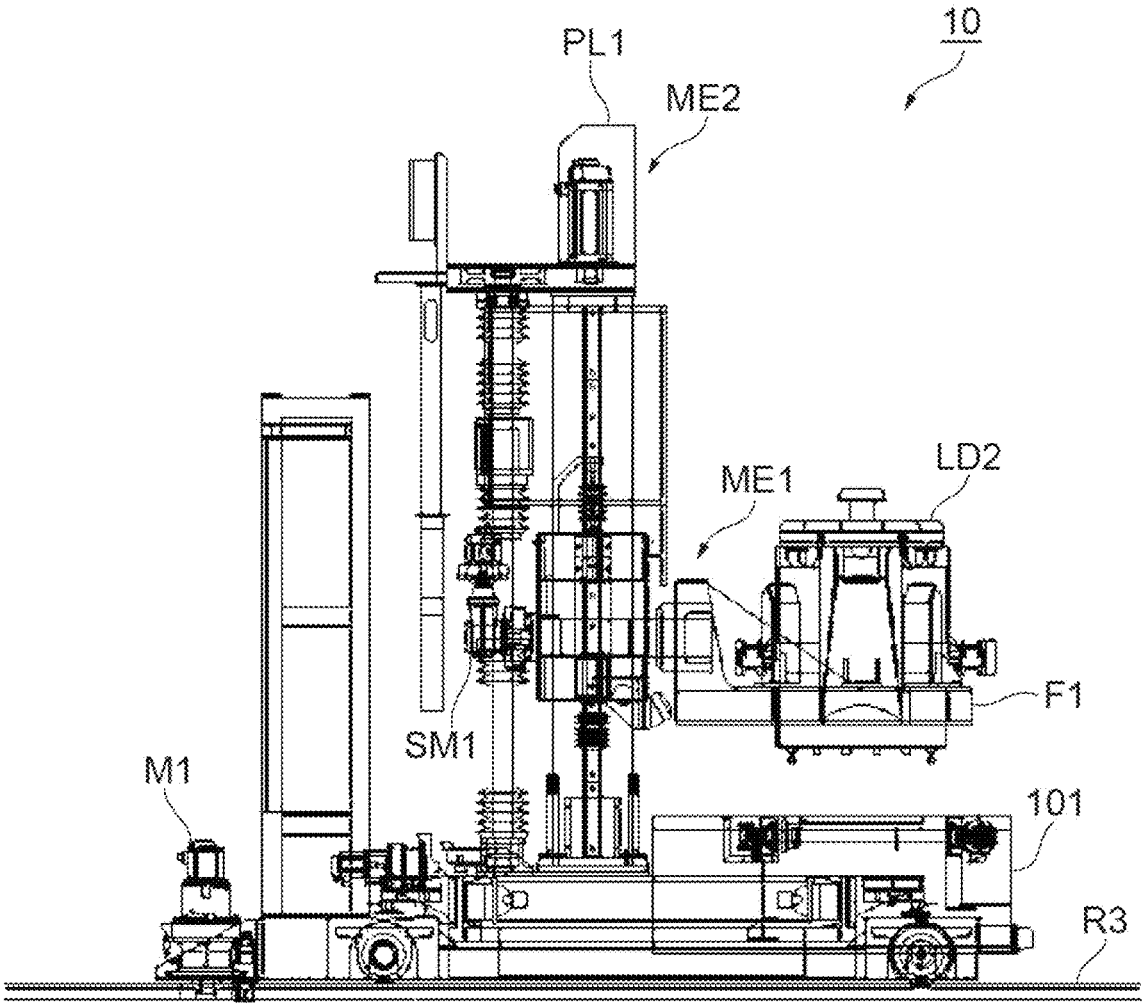
FIG. 2 is a side view of a pouring machine according to an exemplary embodiment.
Figure 2:
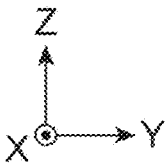
Figure 3:
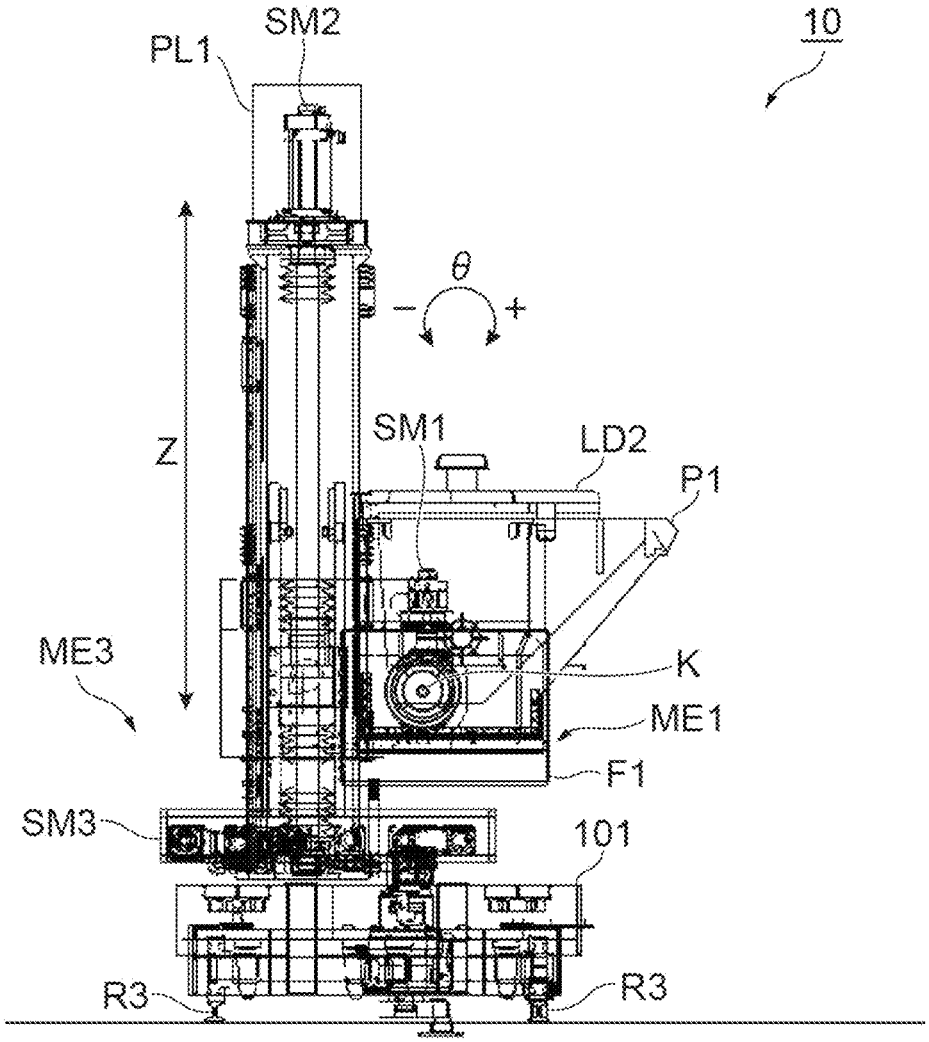
FIG. 3 is a front view of the pouring machine according to the exemplary embodiment.
Figure 3:
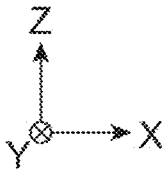

FIG. 2 is a side view of the pouring machine according to the exemplary embodiment, and FIG. 3 is a front view of the pouring machine according to the exemplary embodiment. As shown in FIGS. 2 and 3, the pouring machine 10 includes a molten-metal pouring bogie 101. The molten-metal pouring bogie 101 carries the pouring ladle LD2 thereon and travels along the pouring rail R3.

The molten-metal pouring bogie 101 includes a traveling motor. The wheels of the molten-metal pouring bogie 101 is rotated by driving a motor M1 for traveling, and the molten-metal pouring bogie 101 travels on the pouring rail R3 (in a Y-direction in the figures). This allows the pouring ladle LD2 to move along the row of the molds. Furthermore, the pouring ladle LD2 is tiltably supported by a tilting mechanism ME1. The tilting mechanism ME1 includes a tilting motor SM1 as a drive source, and tilts a tilting frame F1 and the pouring ladle LD2 about a tilting axis K extending in the Y-direction in the figures (θ direction in the figures).

The tilting frame F1 is a member which carries the pouring ladle LD2 thereon and tilts together with the pouring ladle LD2. The tilting mechanism ME1 can tilt the tilting frame F1 and the pouring ladle LD2 in a front-rear direction with reference to a vertical direction. The front-rear direction includes a +θ-direction which is the first direction, and a −θ-direction which is the second direction.

Furthermore, the tilting frame F1 and the pouring ladle LD2 are supported by a lifting mechanism ME2 in such a way as to be movable up and down. The lifting mechanism ME2 includes a lifting motor SM2 (an example of a lifting drive unit) as a drive source, and a lifting pole PL1 as a support member, and raises and lowers the tilting mechanism ME1 along the lifting pole PL1 (Direction Z in the figures). The lifting pole PL1 is provided with a ball screw and a linear guide. As a result, the tilting frame F1 and the pouring ladle LD2 move up and down together with the tilting mechanism ME1, which makes it possible to pour molten metal at a predetermined height.

Furthermore, the tilting frame F1 and the pouring ladle LD2 are movably supported by a forward/backward moving mechanism ME3 (an example of a front-rear mechanism). The forward/backward moving mechanism ME3 includes a moving motor SM3 as a drive source, and moves the lifting mechanism ME2 (in an X-direction in the figures). As a result, the tilting frame F1 and the pouring ladle LD2 are movable together with the tilting mechanism ME1 and the lifting mechanism ME2 in such a direction as to be close to or away from the mold MD.

As described above, the pouring ladle LD2 mounted on the tilting frame F1 can move to any position in the XYZ directions in the figures and tilt at any tilting angle. The tilting frame F1 and the pouring ladle LD2 are tilted in the +θ-direction from predetermined height and posture by the tilting mechanism ME1, the lifting mechanism ME2, and the forward/backward moving mechanism ME3, and molten metal is poured into a mold MD from a first tapping port P1 of the pouring ladle LD2. Note that the tilting motor SM1, the lifting motor SM2, and the moving motor SM3 are, for example, servo motors.

The pouring machine 10 can tilt the pouring ladle LD2 together with the tilting frame F1 in the −θ-direction in order to discharge waste molten metal into the molten-metal discharging container 16. The pouring machine 10 includes a fixing member for fixing the pouring ladle LD2 to the tilting frame F1 in order to tilt the pouring ladle LD2 in the −θ-direction.

(Details of Fixing Member)

Figure 4:
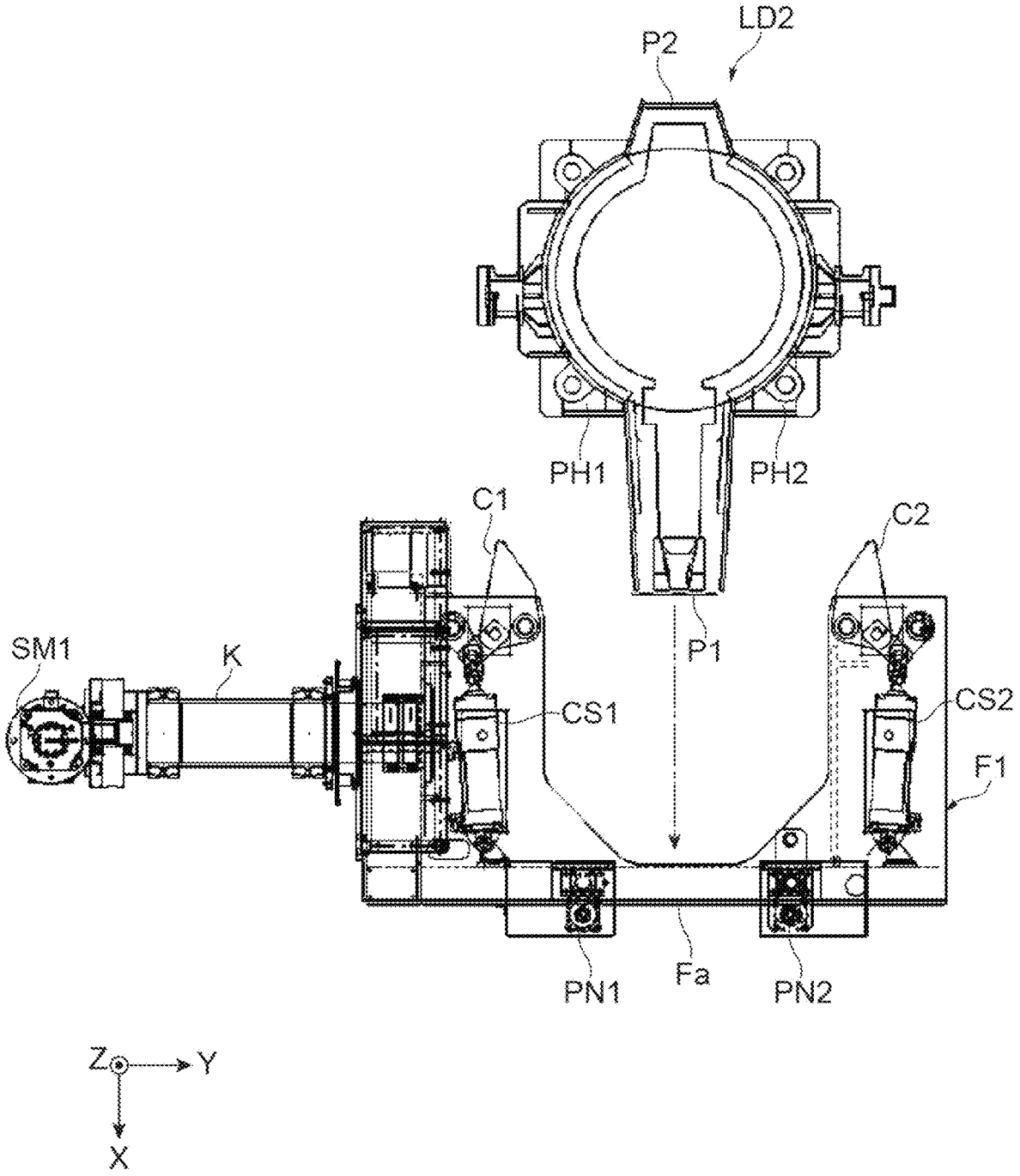
FIG. 4 is a plane view showing a clamping member (open state) for fixing a ladle to a tilting frame.
Figure 5:
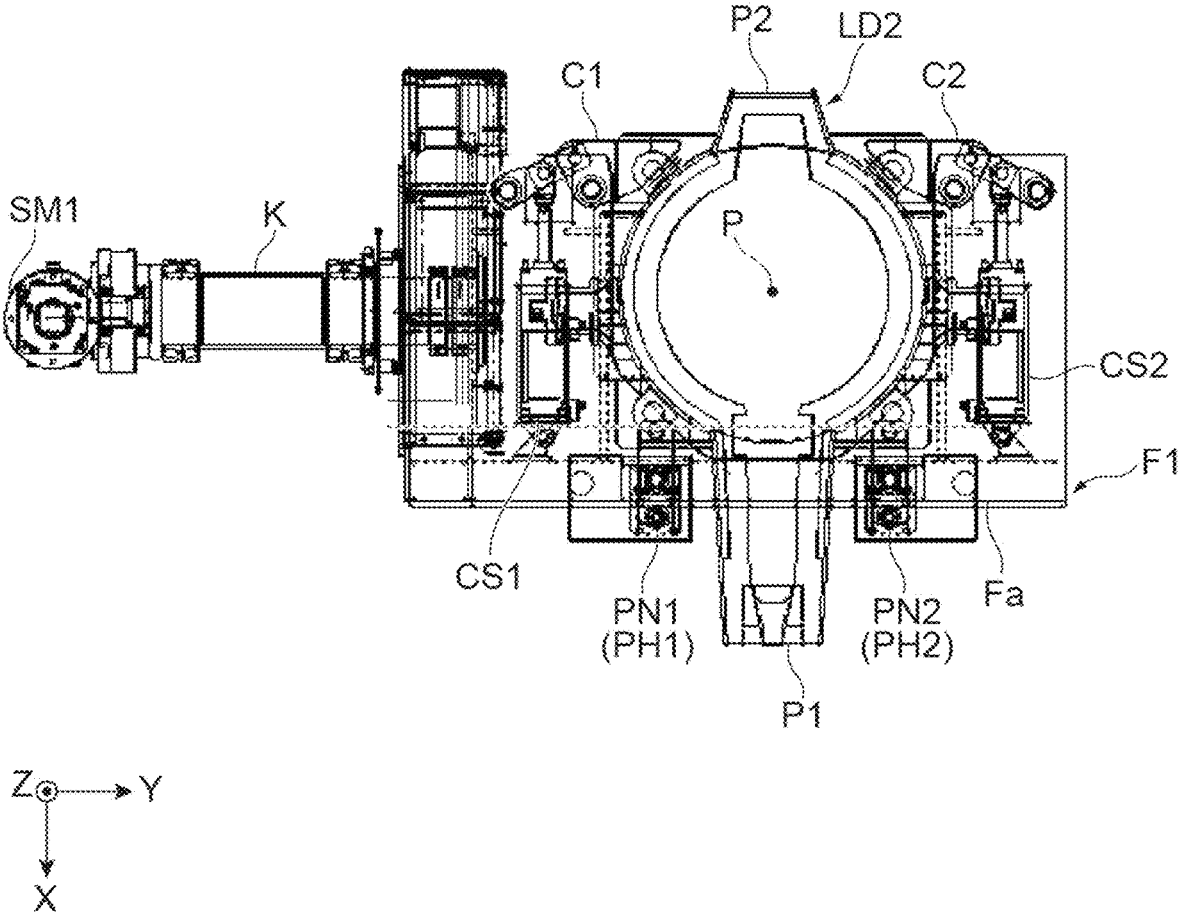
FIG. 5 is a plane view showing the clamping member (closed state) for fixing the ladle to the tilting frame.

FIG. 4 is a plane view showing a clamping member (open state) for fixing the ladle to the tilting frame. FIG. 5 is a plane view showing the clamping member (closed state) for fixing the ladle to the tilting frame. The pouring ladle LD2 advances in the X-direction as shown by an arrow from a state where it is away from the tilting frame F1 as shown in FIG. 4, and is placed and fixed on the tilting frame F1 as shown in FIG. 5.

As shown in FIG. 4, the tilting frame F1 has a wall member Fa against which the pouring ladle LD2 abuts. The wall member Fa is a substantially plate-shaped member erected on the tilting frame F1. The wall member Fa functions as a positioning stopper for the pouring ladle LD2 and supports the pouring ladle LD2 when the pouring ladle LD2 tilts in the +θ-direction.

Further, the tilting frame F1 is provided with a first clamping member C1 and a second clamping member C2 as an example of the fixing member. The first clamping member C1 is driven by a first clamping cylinder CS1 (an example of a clamping drive unit) and controlled to be set to an open state (FIG. 4) or a closed state (FIG. 5). The second clamping member C2 is likewise driven by a second clamping cylinder CS2 (an example of the clamping drive unit) and controlled to be set to an open state (FIG. 4) or a closed state (FIG. 5). The first clamping cylinder CS1 and the second clamping cylinder CS2 are, for example, air cylinders.

As shown in FIG. 4, until the pouring ladle LD2 is placed on the tilting frame F1, the first clamping member C1 and the second clamping member C2 keep the open state to establish a state where the tilting frame F1 is allowed to pass between the first clamping member C1 and the second clamping member C2. The pouring ladle LD2 advances in the X-direction, passes between the first clamping member C1 and the second clamping member C2, abuts against the wall member Fa, and stops. When the pouring ladle LD2 stops, the first clamping member C1 and the second clamping member C2 are set to the closed state as shown in FIG. 5. The first clamping member C1 and the second clamping member C2 are set to the closed state, whereby the first clamping member C1 and the second clamping member C2 clamp the pouring ladle LD2 among them and the wall member Fa. As a result, the pouring ladle LD2 is fixed to the tilting frame F1.

Figure 6:
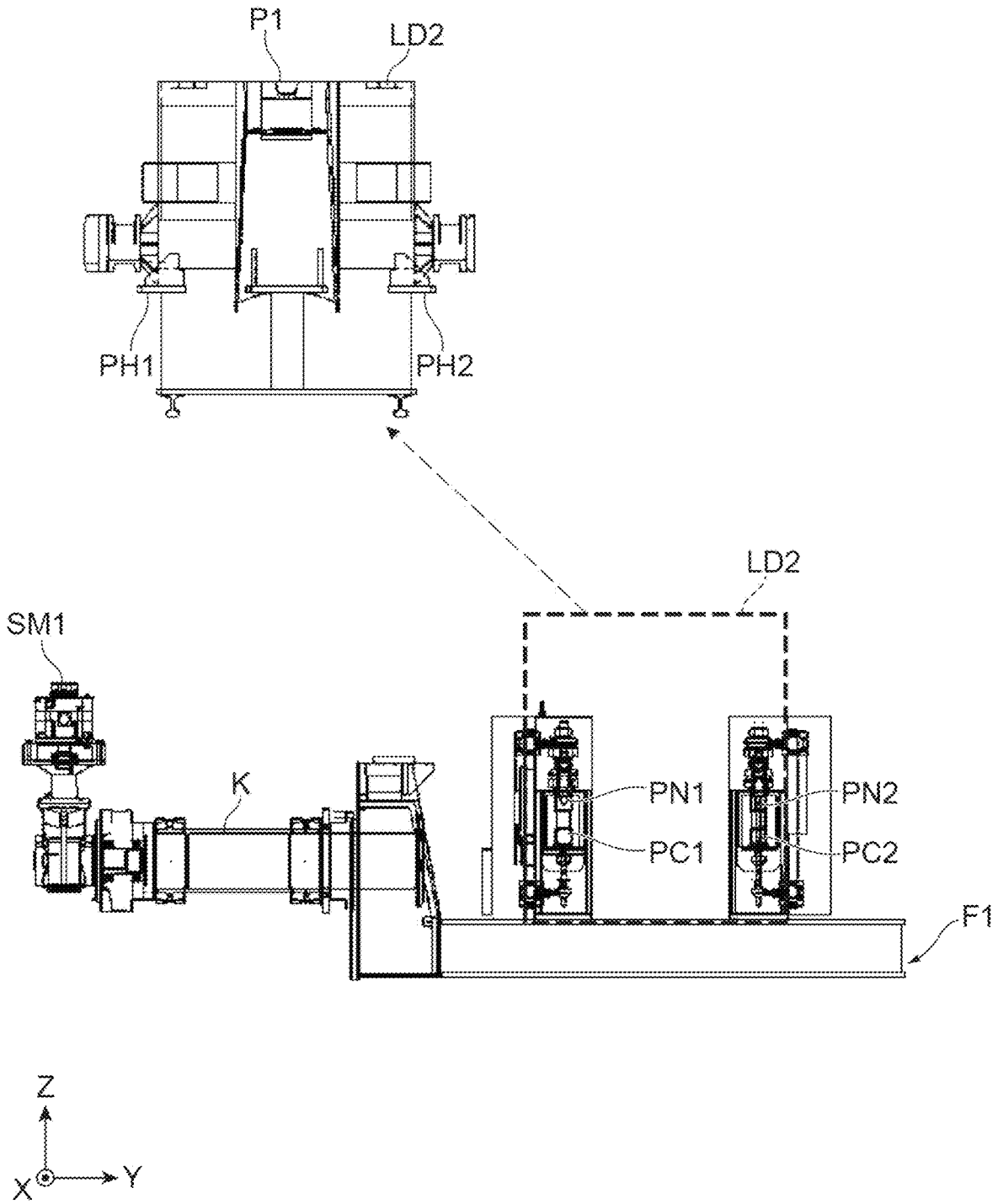
FIG. 6 is a side view showing pins and pin receiving portions that fix the ladle to the tilting frame.
Figure 7:
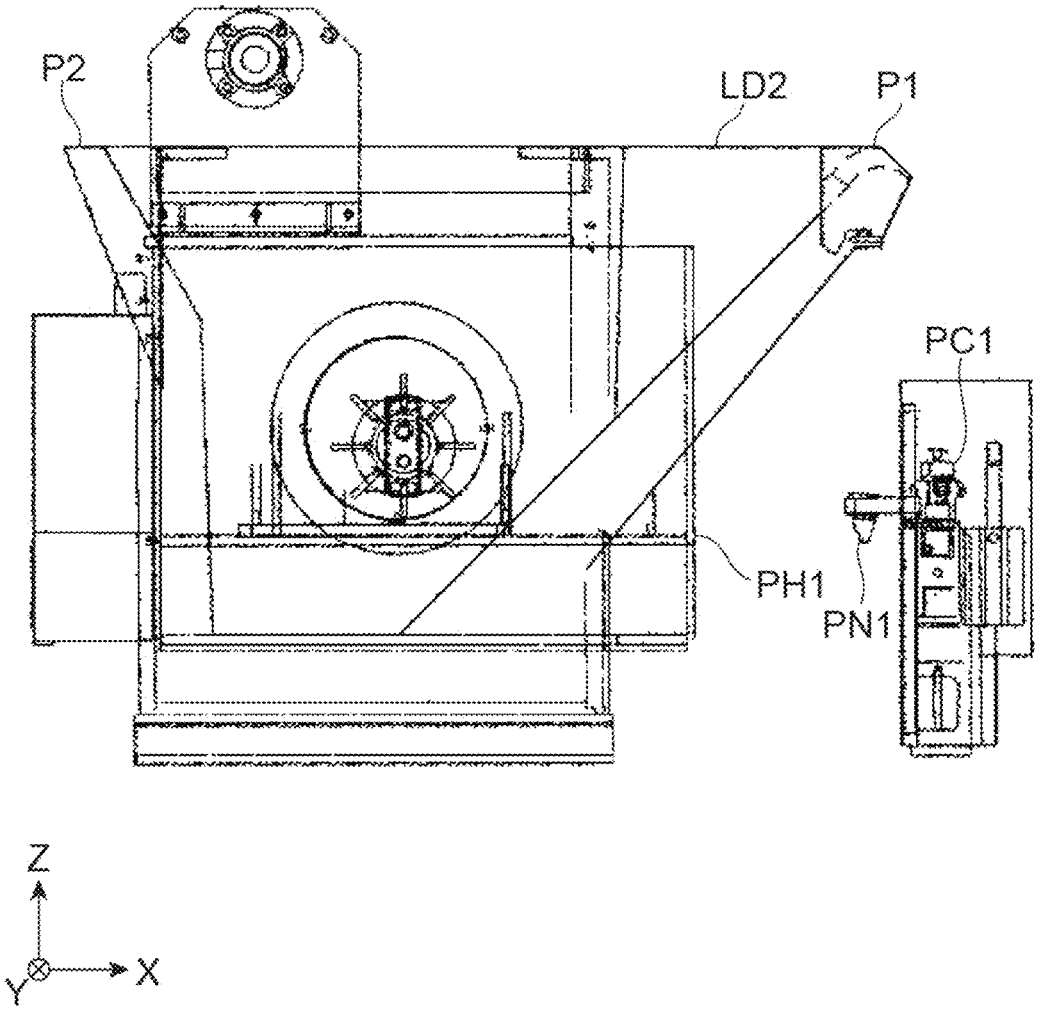
FIG. 7 is a front view showing the pin and the pin receiving portion that fix the ladle to the tilting frame.

The pouring ladle LD2 is further fixed to the tilting frame F1 by pins while placed on the tilting frame F1 as shown in FIG. 5. FIG. 6 is a side view showing pins and pin receiving portions for fixing the ladle to the tilting frame. In FIG. 6, considering the overlapping of members, the pouring ladle LD2 is moved from a position indicated by a dashed line to a position indicated by an arrow for the sake of description. FIG. 7 is a front view showing pins and pin receiving portions for fixing the ladle to the tilting frame.

As shown in FIGS. 4, 6 and 7, the front surface of the pouring ladle LD2 includes a first pin receiving portion PH1 and a second pin receiving portion PH2. The first pin receiving portion PH1 and the second pin receiving portion PH2 are, for example, members each having a hole in which a pin can be fitted.

A first pin PN1 to engage with the first pin receiving portion PH1 is provided as an example of the fixing member in the tilting frame F1. The first pin PN1 is vertically driven by a first pin cylinder PC1 (an example of a pin drive unit). The second pin PN2 is likewise vertically driven by a second pin cylinder PC2 (an example of the pin drive unit). The first pin cylinder PC1 and the second pin cylinder PC2 are, for example, air cylinders. As shown in FIG. 5, when the pouring ladle LD2 is placed on the tilting frame F1, the first pin PN1 descends, and engages with the first pin receiving portion PH1. The second pin PN2 likewise descends and engages with the second pin receiving portion PH2. As a result, the pouring ladle LD2 is further fixed to the tilting frame F1.

(Pouring Ladle)

As shown in FIG. 5, the pouring ladle LD2 has a first tapping port P1 and a second tapping port P2. The first tapping port P1 is a tapping port for pouring molten metal. The second tapping port P2 is a tapping port for discharging waste molten metal. When viewed from an upper side of the pouring ladle LD2, the first tapping port P1, the center P of the ladle, and the second tapping port P2 are arranged to be aligned with one another.

(Operation of Pouring Machine)

Figure 8:
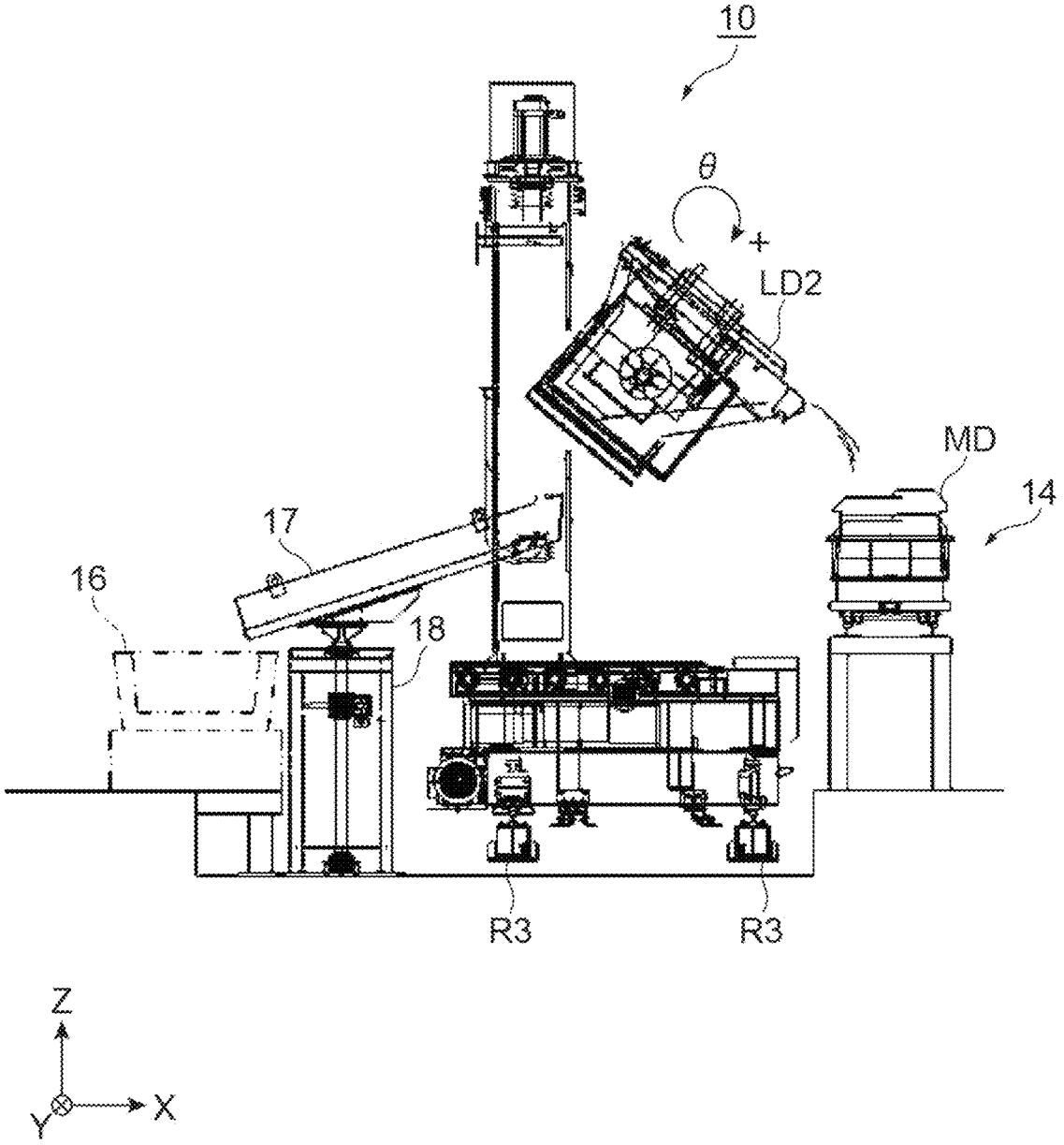
FIG. 8 is a front view showing pouring processing of the pouring machine.

FIG. 8 is a front view showing a pouring treatment of the pouring machine. As shown in FIG. 8, as the pouring treatment, the pouring machine 10 tilts the pouring ladle LD2 in the first direction (+0-direction) in the pouring zone 14. As a result, molten metal is poured from the pouring ladle LD2 into a mold MD. Here, when the temperature of molten metal decreases to a threshold value or less during the pouring treatment, there is a change in the material of molten metal to be poured into molds MD, or molten metal for one mold or less remains, a molten-metal discharging treatment is performed.

Figure 9:
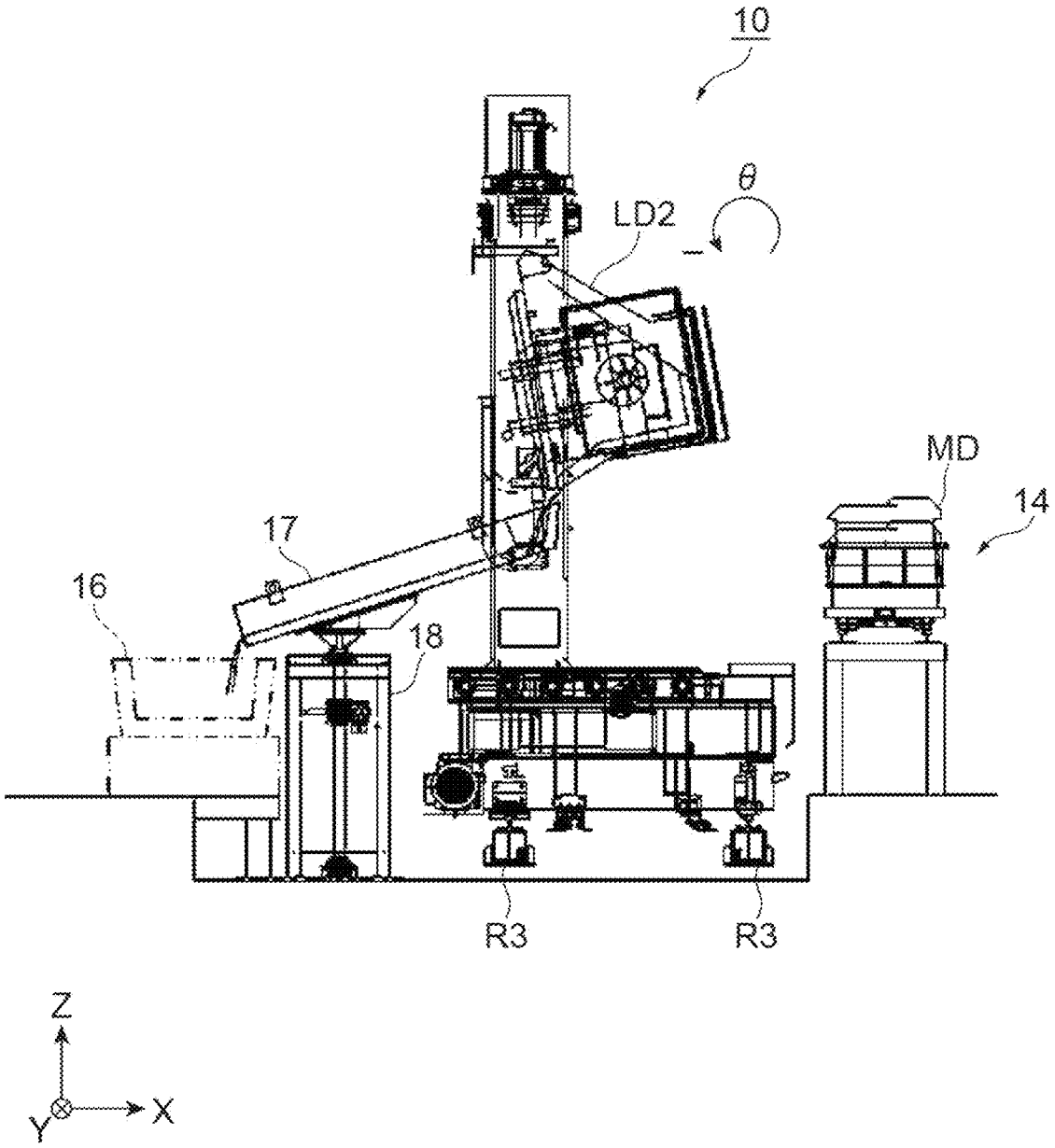
FIG. 9 is a front view showing discharging processing of the pouring machine.

FIG. 9 is a front view showing the molten-metal discharging treatment of the pouring machine. As shown in FIG. 9, as the molten-metal discharging treatment, the pouring machine 10 tilts the pouring ladle LD2 in the second direction (−θ-direction) in the pouring zone 14. As a result, waste molten metal is discharged from the pouring ladle LD2 into the molten-metal discharging container 16. Here, a launder 17 for guiding molten metal from the pouring ladle LD2 to the molten-metal discharging container 16 may be provided between the pouring machine and the molten-metal discharging container 16. In this case, the molten metal in the pouring ladle LD2 is guided to the molten-metal discharging container 16 by the launder 17. By providing the launder 17, the pouring facility 1 enables the molten-metal discharging container 16 to have flexibility to the layout thereof, and also can prevent the molten metal from overflowing when it is discharged.

The launder 17 may be movably supported by a launder moving mechanism 18. The launder moving mechanism 18 supports the launder 17 such that the launder 17 is turnable, for example. The launder moving mechanism 18 moves the launder 17 according to the position of the pouring machine 10. For example, the launder moving mechanism 18 moves the launder 17 above the pouring rail R3 during the molten-metal discharging treatment in which the pouring machine 10 is located in front of the molten-metal discharging container 16. The launder moving mechanism 18 is retracted from above the pouring rail R3 during the pouring treatment. As a result, it is possible to prevent the launder 17 from interfering with the pouring machine 10.

Summary of Embodiment

In the pouring facility 1, the pouring ladle LD2 is tilted in the first direction by the pouring machine 10, and the molten metal in the pouring ladle LD2 is poured into the mold MD on the mold conveying device. The pouring ladle LD2 can also be tilted in the second direction opposite to the first direction by the pouring machine 10. Since the pouring machine 10 moves on the pouring rail R3 located between the mold conveying device and the molten-metal discharging container 16, the molten-metal discharging container 16 is present in the second direction opposite to the first direction. In other words, when the pouring ladle LD2 is tilted in the second direction by the pouring machine 10, the molten metal in the pouring ladle LD2 is discharged into the molten-metal discharging container 16. In this way, the pouring facility 1 tilts the pouring ladle LD2 in the first direction to perform the pouring treatment for the mold MD, and tilts the pouring ladle LD2 in the second direction to perform the molten-metal discharging treatment for the molten-metal discharging container 16. Therefore, the pouring facility 1 can discharge the waste molten metal without moving the pouring machine 10 from the pouring zone 14, so that it is possible to efficiently discharge the waste molten metal.

Hereinafter, comparative examples will be described in order to describe the effects of the pouring facility 1 according to the embodiment in detail.

Figure 10:
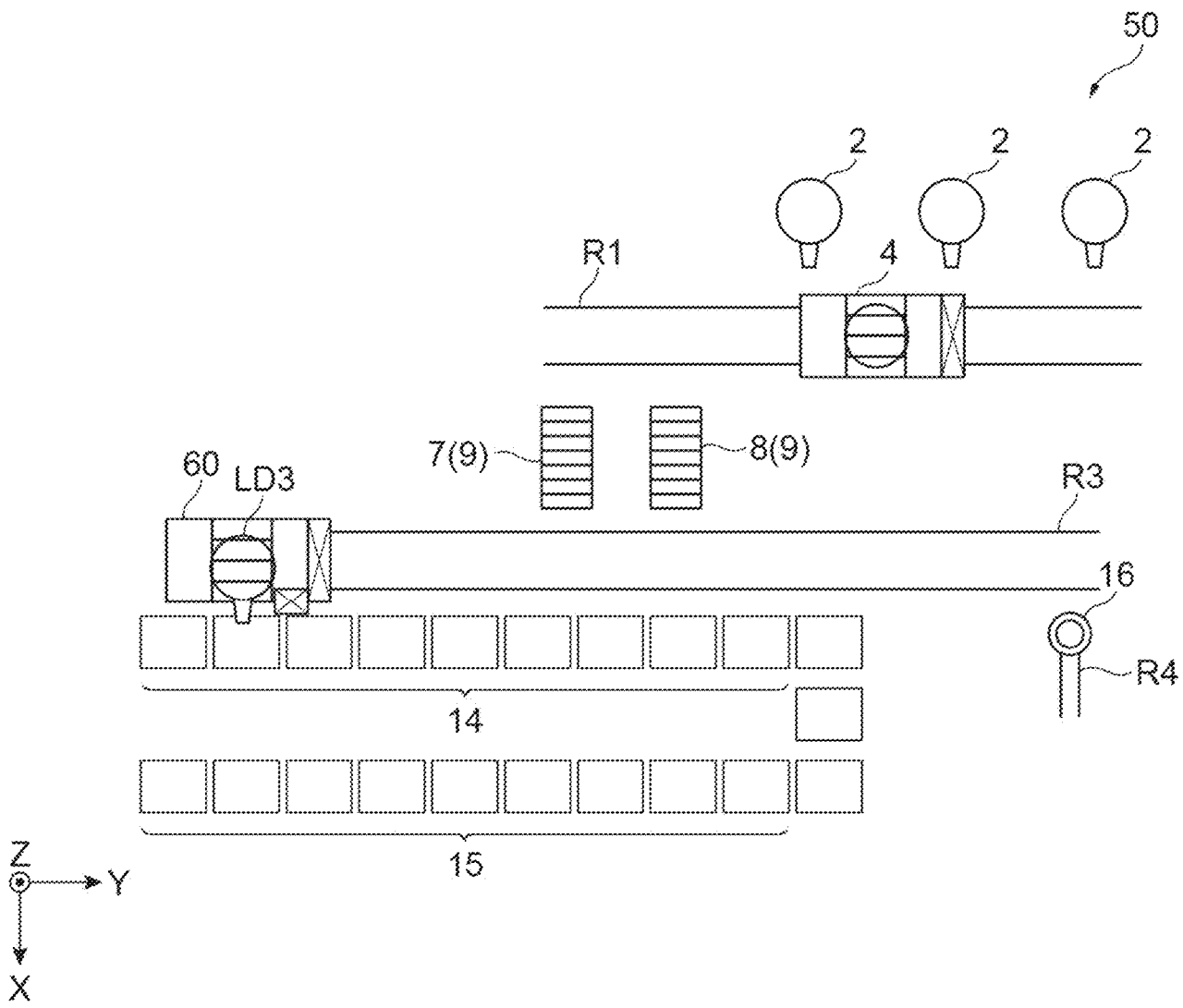
FIG. 10 is a plane view showing a part of casting facility including pouring facility according to a comparative example.

FIG. 10 is a plane view showing a part of casting facility equipped with pouring facility according to a comparative example. In comparison with the casting facility 100 shown in FIG. 1, first comparative casting facility 50 differs in that it includes a first pouring machine 60 in place of the pouring machine 10 and in the arrangement position of the molten-metal discharging container 16, and is otherwise identical. In the following description, differences will be mainly described, and redundant description on the configurations will be omitted.

In comparison with the pouring machine 10, the first pouring machine 60 has a configuration which can be tilted only in the first direction, and is otherwise identical. In other words, the first pouring machine 60 is a pouring machine that can only tilt forward. In this case, as shown in FIG. 10, the arrangement position of the molten-metal discharging container 16 is a position to which the pouring rail R3 is extended beyond the pouring zone 14. In the first comparative casting facility 50, it is necessary for the first pouring machine 60 to travel by a distance longer than the pouring zone 14 for discharging of waste molten metal, which may cause a risk of a cycle delay. Note that the molten-metal discharging container 16 which has been poured is conveyed by a discharging rail R4.

Figure 11:
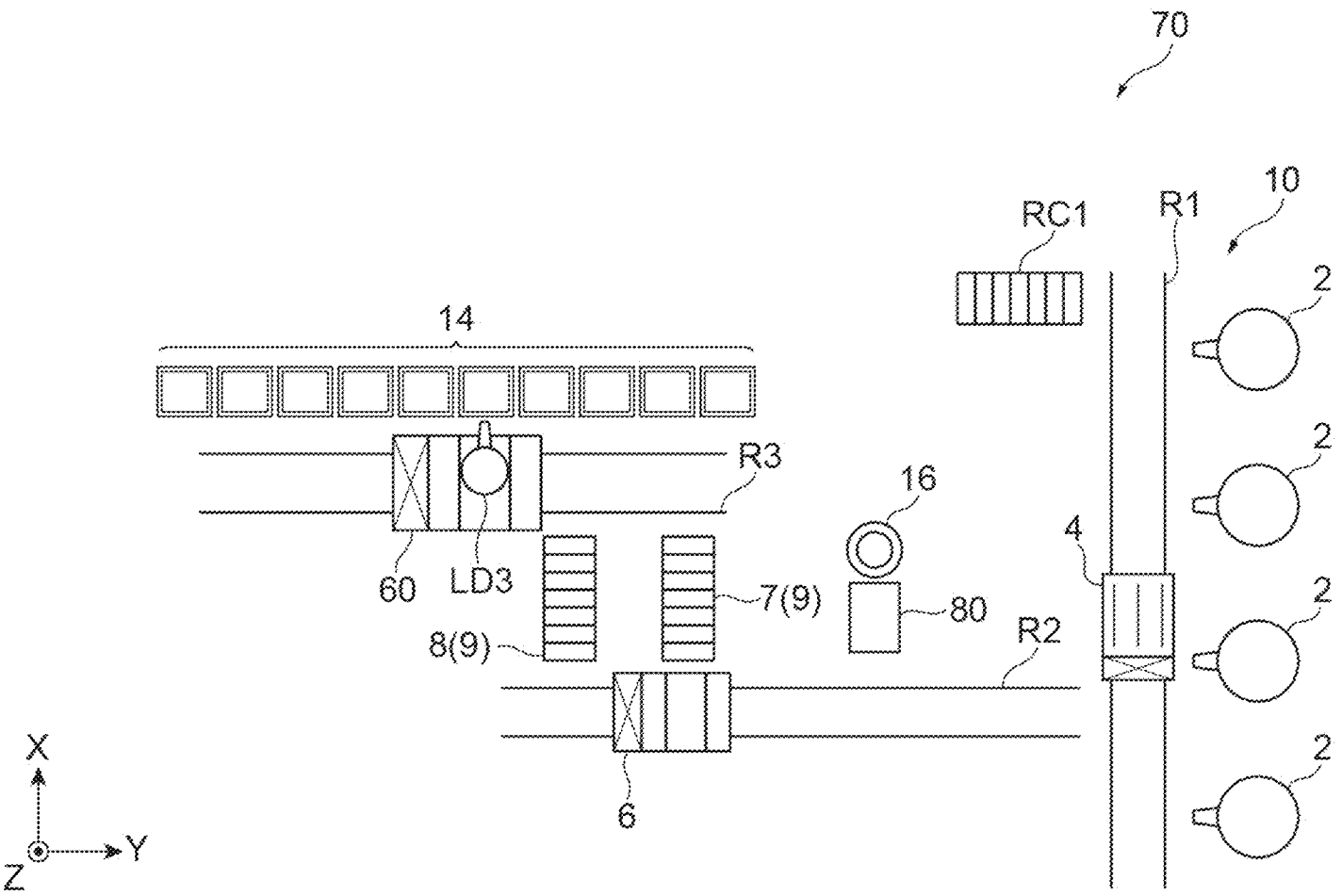
FIG. 11 is a plane view showing a part of casting facility including pouring facility according to another comparative example.

FIG. 11 is a plane view showing a part of casting facility equipped with pouring facility according to another comparative example. In comparison with the casting facility 100 shown in FIG. 1, second comparative casting facility 70 differs in that it includes a first pouring machine 60 in place of the pouring machine 10, in that it includes a molten-metal discharging device 80, in that it includes a roller conveyor RC1 for the returning of molten metal described above, and in the arrangement position of the molten-metal discharging container 16, and is otherwise identical. In the following description, differences will be mainly described, and redundant description on the configuration will be omitted.

Figure 12A:
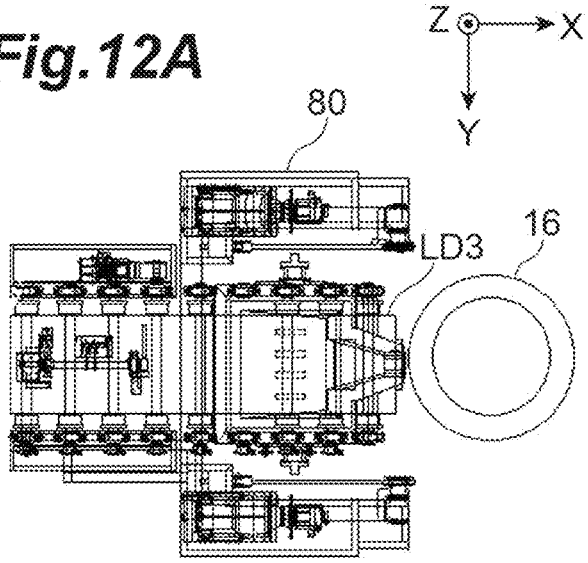
FIGS. 12A to 12C are diagrams showing an example of a discharging device shown in FIG. 11.
Figure 12B:
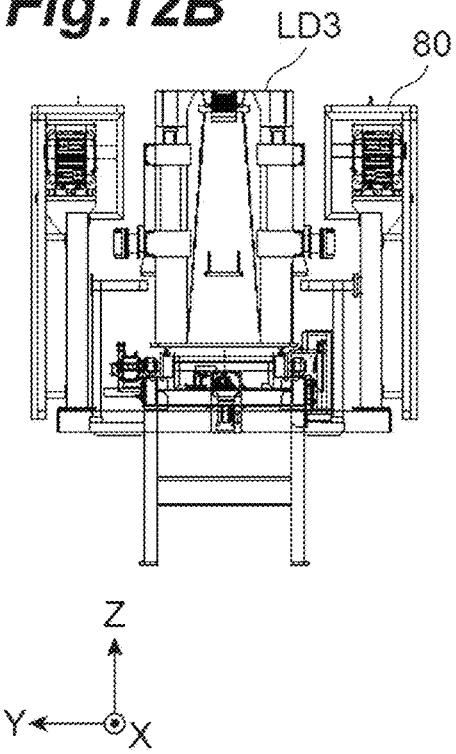
Figure 12C:
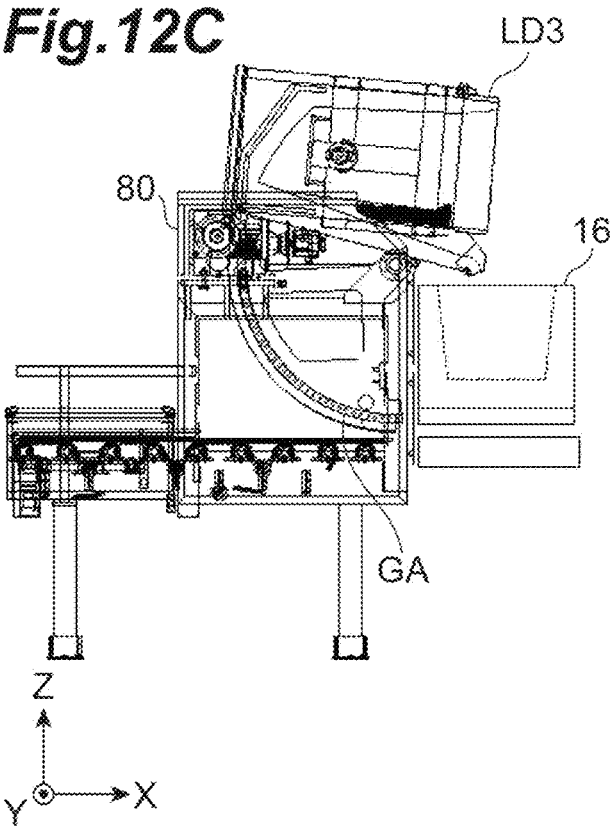

The arrangement position of the molten-metal discharging container 16 is provided in the vicinity of the transportation bogie rail R2. The pouring ladle LD3 having waste molten metal is transported from the first pouring machine 60 to the transportation bogie 6 running on the transportation bogie rail R2. A molten-metal discharging device 80 receives the pouring ladle LD3 from the transportation bogie 6, and discharges waste molten metal into the molten-metal discharging container 16. FIGS. 12A to 12C are diagrams showing an example of the molten-metal discharging device shown in FIG. 11, where FIG. 12A is a plane view of the molten-metal discharging device, FIG. 12B is a front view of the molten-metal discharging device, and FIG. 12C is a side view of the molten-metal discharging device. As shown in FIGS. 12A to 12C, the molten-metal discharging device 80 has a sector gear GA for tilting the pouring ladle LD3 forward. In the second comparative casting facility 70, it is necessary to provide the molten-metal discharging device 80, the facility increases in scale and the delivery of the pouring ladle LD3, etc. are required, which may cause a risk of a cycle delay.

Figure 13:
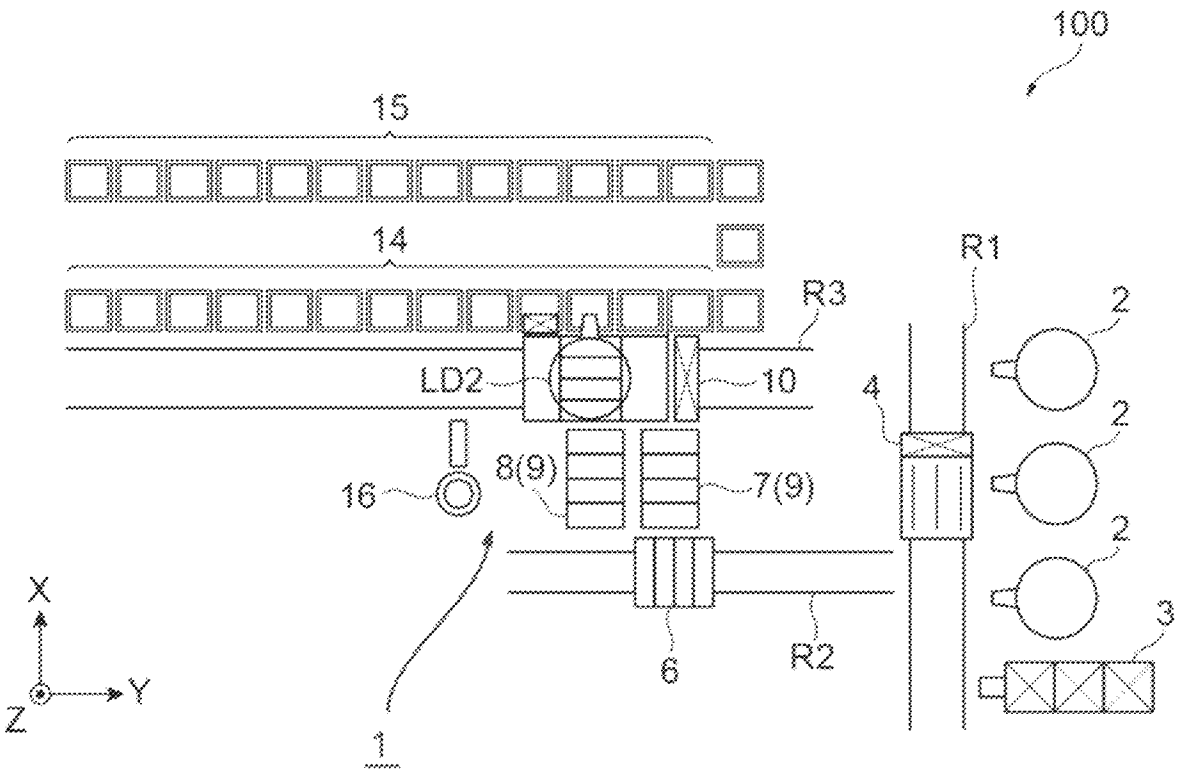
FIG. 13 is a plane view showing the casting facility of FIG. 1 in a simplified manner.

The casting facility 100 according to the embodiment will be described in comparison with the comparative examples described above. FIG. 13 is a simplified plane view of the casting facility of FIG. 1. Comparing the first comparative casting facility 50 shown in FIG. 10 and the casting facility 100 shown in FIG. 13, a travel distance by which the pouring machine travels to discharge waste molten metal is shorter in the casting facility 100. Therefore, the casting facility 100 can shorten a time cycle as compared with the first comparative casting facility 50. Further, comparing the second comparative casting facility 70 shown in FIG. 11 with the casting facility 100 shown in FIG. 13, the number of devices to be configured can be reduced in the casting facility 100. Therefore, the casting facility 100 can be simplified in configuration as compared with the first comparative casting facility 50.

The various exemplary embodiments have been described above, but various omissions, substitutions, and modifications may be made without being limited to the exemplary embodiments described above. For example, in the above-described embodiments, the lifting mechanism ME2 includes one lifting motor SM2 and one lifting pole PL1, but the lifting mechanism ME2 may include at least one lifting motor SM2, and at least one lifting pole PL1.

Figure 14:
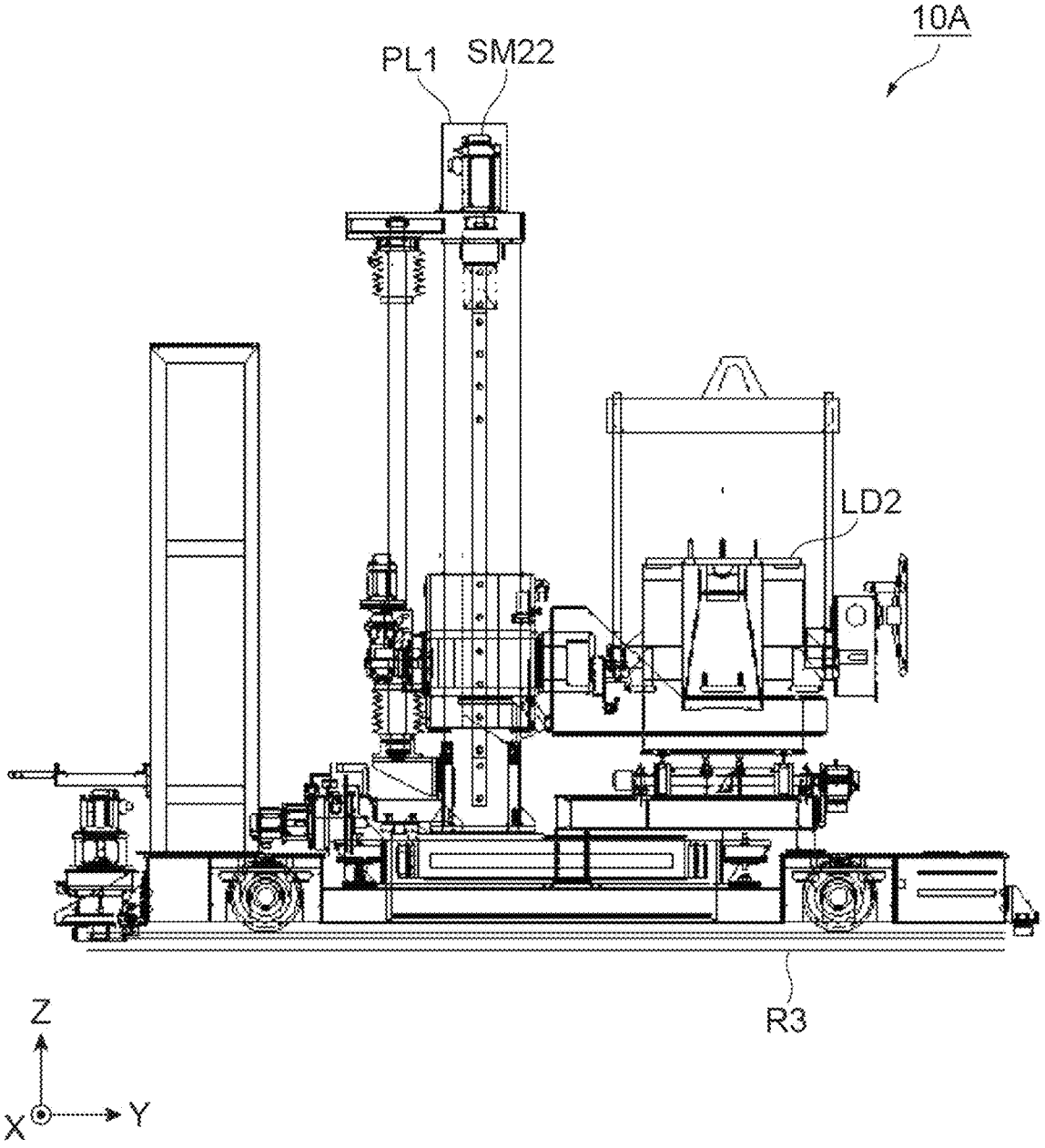
FIG. 14 is a side view of a pouring machine according to a modification.
Figure 15:
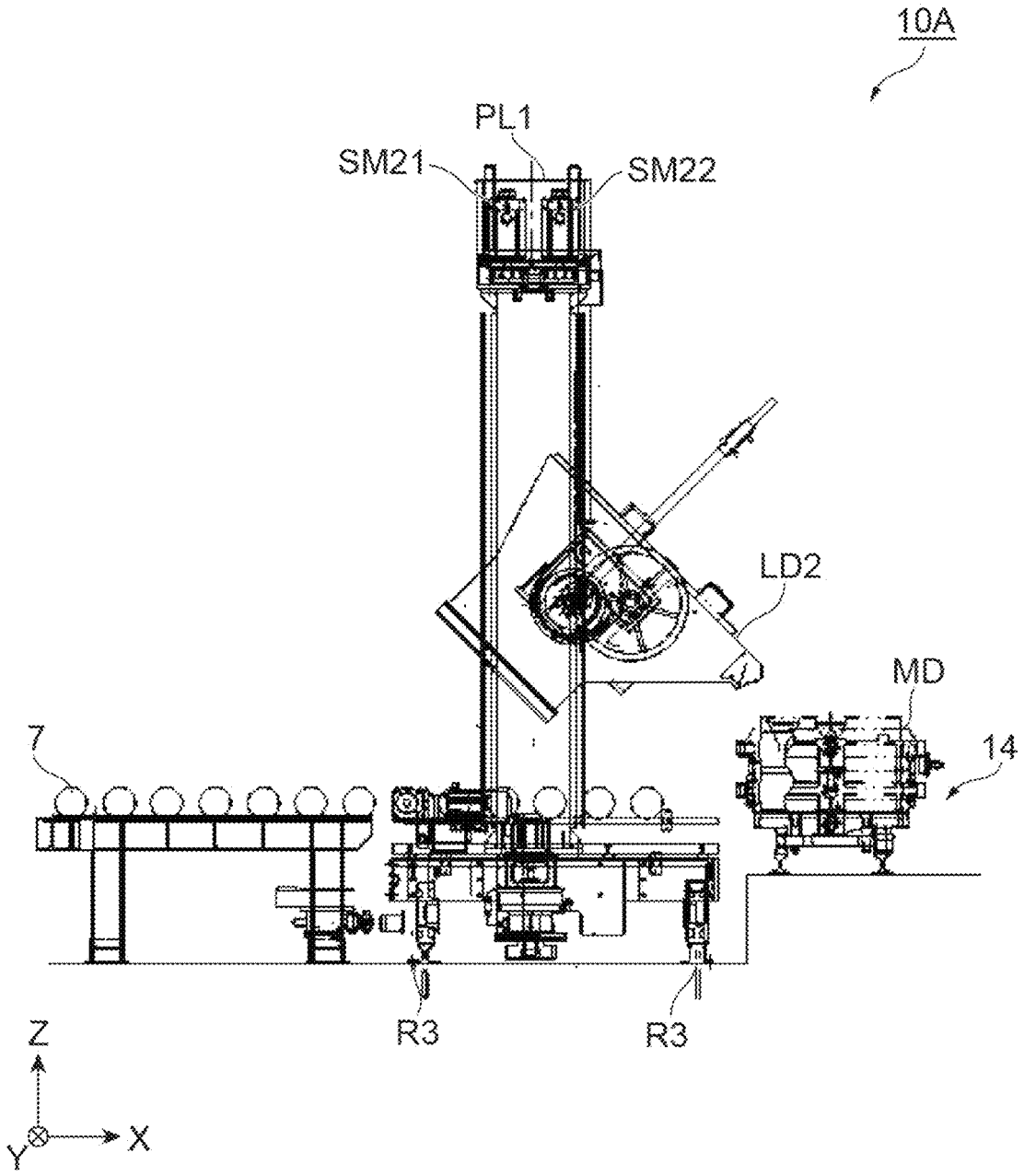
FIG. 15 is a front view of the pouring machine shown in FIG. 14.
Figure 16:
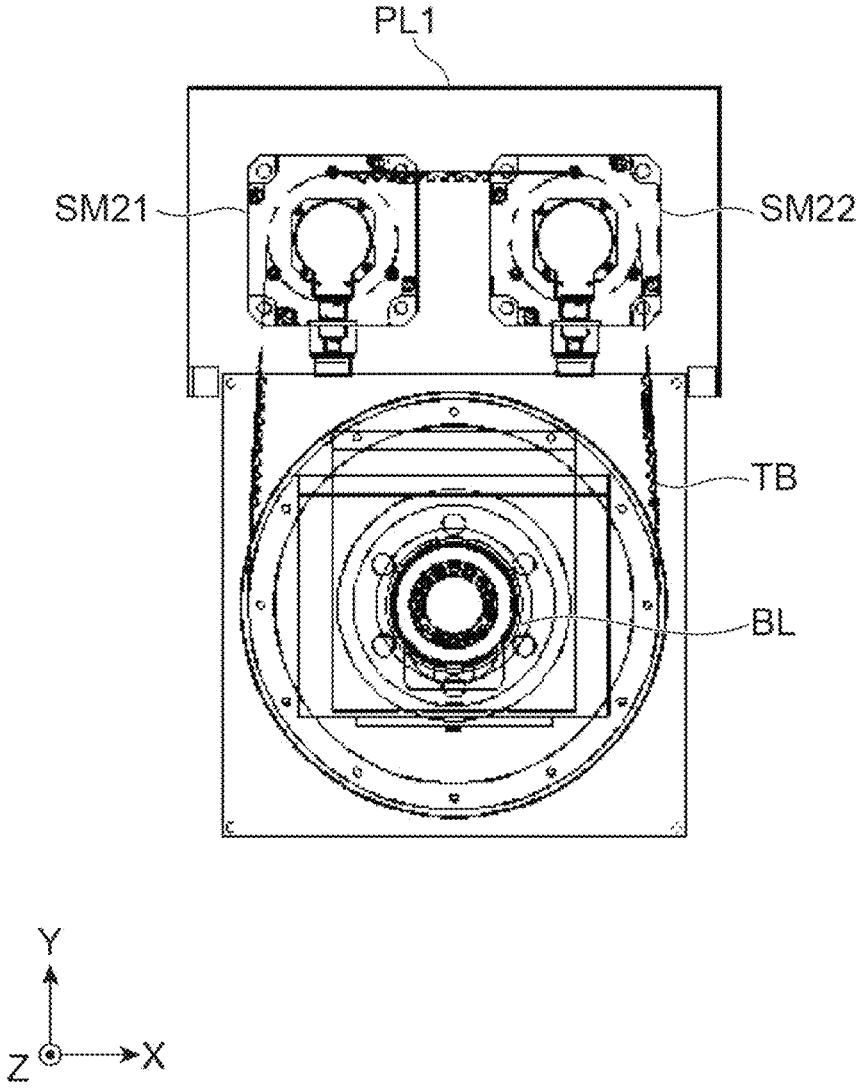
FIG. 16 is a plane view showing a lifting mechanism.

FIG. 14 is a side view of a pouring machine according to a modification. FIG. 15 is a front view of the pouring machine shown in FIG. 14. FIG. 16 is a plane view showing a lifting mechanism. As shown in FIGS. 14 and 15, the pouring machine 10A is provided with a first lifting motor SM21 and a second lifting motor SM22 on a lifting pole PL1. As shown in FIG. 16, the first lifting motor SM21 and the second lifting motor SM22 are connected to a ball screw BL provided on the lifting pole PL1 with a timing belt TB. As a result, the pouring ladle LD2 can be raised and lowered by the two drive sources of the first lifting motor SM21 and the second lifting motor SM22.

Figure 17:
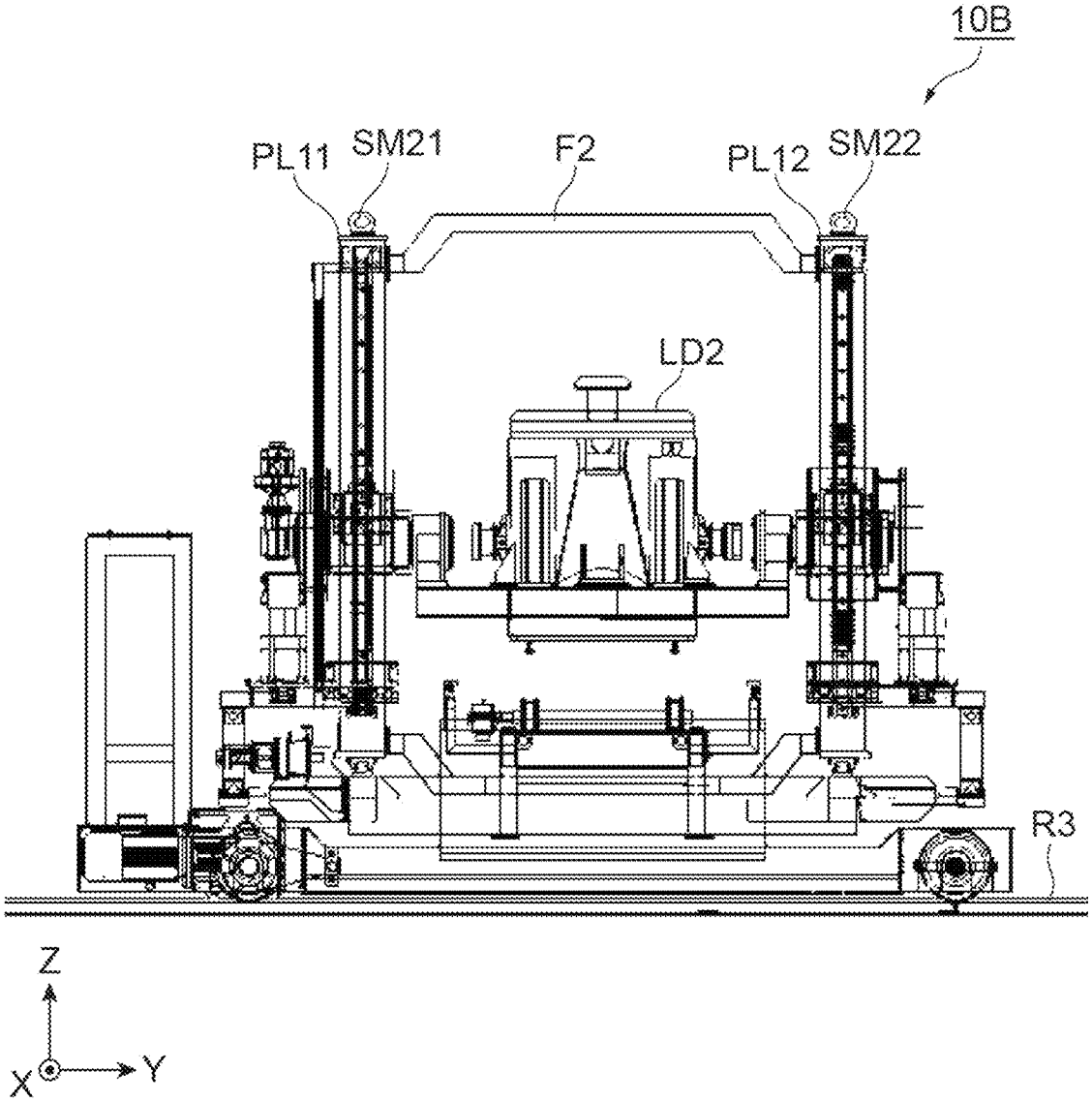
FIG. 17 is a side view of a pouring machine according to another modification.
Figure 18:
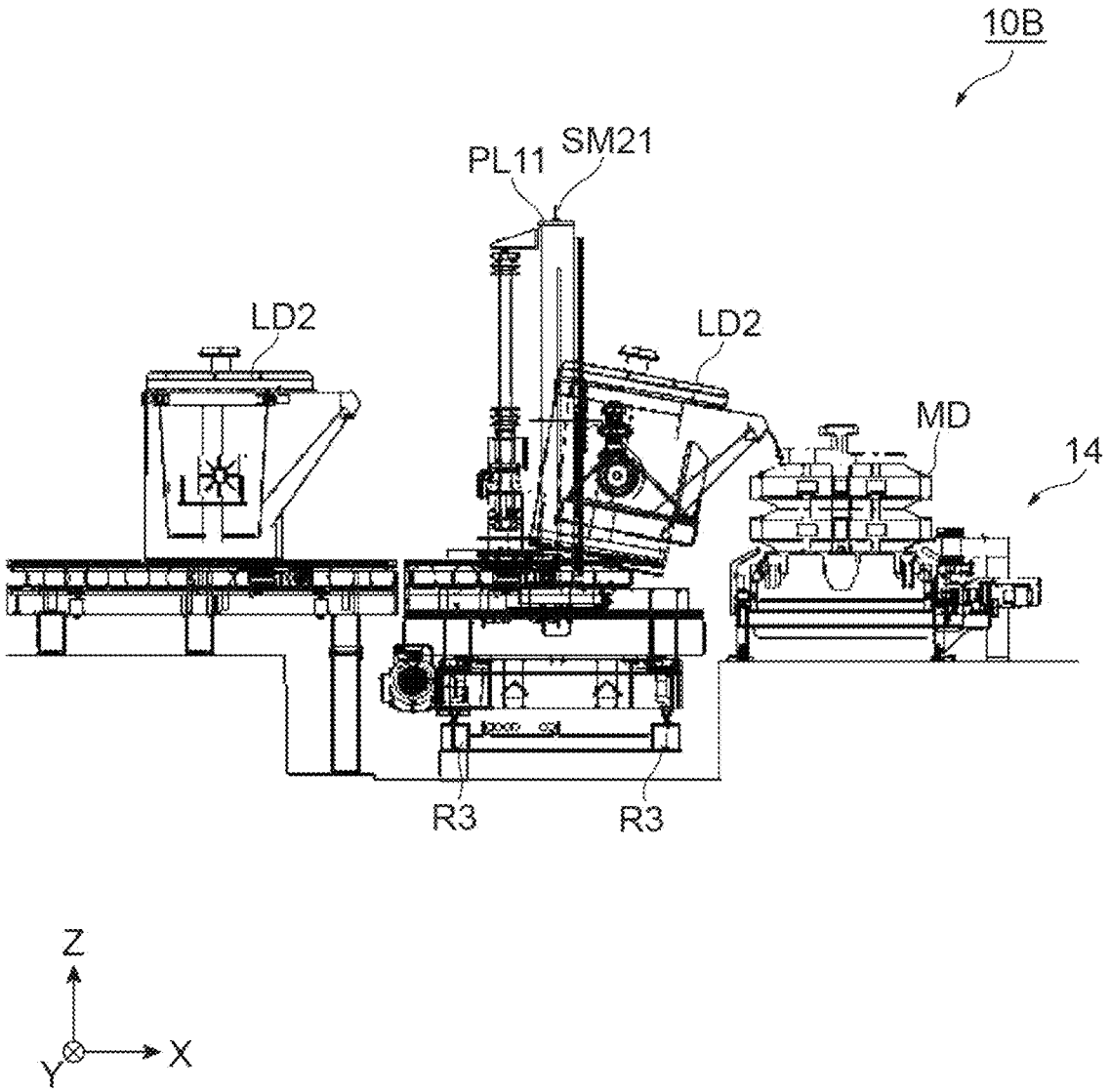
FIG. 18 is a front view of the pouring machine shown in FIG. 17.

FIG. 17 is a side view of a pouring machine according to another modification. FIG. 18 is a front view of the pouring machine shown in FIG. 17. As shown in FIGS. 17 and 18, the pouring machine 10B includes a first lifting pole PL11 and a second lifting pole PL12. The first lifting pole PL11 is provided with a first lifting motor SM21, and the second lifting pole PL12 is provided with a second lifting motor SM22. The first lifting pole PL11 and the second lifting pole PL12 are connected by a frame F2 to constitute a portal mechanism. As a result, the pouring ladle LD2 can be stably raised and lowered by the two lifting poles of the first lifting pole PL11 and the second lifting pole PL12.

What is claimed is:

1. A pouring facility comprising:

a mold conveying device configured to convey a mold;

a molten-metal discharging container configured to store waste molten metal; and a pouring machine movable on a conveyance path located between the mold conveying device and the molten-metal discharging container, the pouring machine being configured to tilt a ladle in a first direction to pour molten metal into the mold conveyed by the mold conveying device, and tilt the ladle in a second direction opposite to the first direction to discharge waste molten metal into the molten-metal discharging container, wherein the pouring machine comprises:

a tilting frame configured to place the ladle thereon, the tilting frame tilting together with the ladle; and a fixing member configured to fix the ladle to the tilting frame, and wherein the ladle includes a pin receiving portion, and the fixing member is provided on the tilting frame, and includes a pin to be fitted in the pin receiving portion, and a pin drive unit configured to drive the pin in an up-and-down direction.

2. The pouring facility according to claim 1, further comprising a launder configured to guide molten metal from the ladle to the molten-metal discharging container.

3. The pouring facility according to claim 2, further comprising a launder moving mechanism configured to move the launder according to a position of the pouring machine.

4. The pouring facility according to claim 1, wherein the ladle has a first tapping port for pouring molten metal into the mold, and a second tapping port for discharging waste molten metal into the molten-metal discharging container, and the first tapping port, a center of the ladle, and the second tapping port are arranged to be aligned with one another when viewed from above the ladle.

5. A pouring facility comprising:

a mold conveying device configured to convey a mold;

a molten-metal discharging container configured to store waste molten metal; and a pouring machine movable on a conveyance path located between the mold conveying device and the molten-metal discharging container, the pouring machine being configured to tilt a ladle in a first direction to pour molten metal into the mold conveyed by the mold conveying device, and tilt the ladle in a second direction opposite to the first direction to discharge waste molten metal into the molten-metal discharging container, wherein the pouring machine comprises:

a tilting frame configured to place the ladle thereon, the tilting frame tilting together with the ladle; and a fixing member configured to fix the ladle to the tilting frame, wherein the tilting frame has a wall member against which the ladle abuts, and the fixing member comprises: a clamping member provided on the tilting frame, the clamping member being configured to clamp the ladle between the clamping member and the wall member; and a clamp drive unit configured to drive the clamping member.

6. A pouring facility comprising:

a mold conveying device configured to convey a mold;

a molten-metal discharging container configured to store waste molten metal; and a pouring machine movable on a conveyance path located between the mold conveying device and the molten-metal discharging container, the pouring machine being configured to tilt a ladle in a first direction to pour molten metal into the mold conveyed by the mold conveying device, and tilt the ladle in a second direction opposite to the first direction to discharge waste molten metal into the molten-metal discharging container, wherein the pouring machine comprises:

a tilting frame configured to place the ladle thereon, the tilting frame tilting together with the ladle;

a fixing member configured to fix the ladle to the tilting frame;

a front-rear mechanism configured to move the tilting frame in a front-rear direction;

a lifting mechanism configured to raise and lower the tilting frame; and a tilting mechanism configured to tilt the tilting frame.

7. The pouring facility according to claim 6, wherein the lifting mechanism comprises:

at least one support member extending in a vertical direction, and configured to support the tilting frame; and at least one lifting drive unit for moving the tilting frame along the at least one support member.

* * * * *